US009265117B2

(12) United States Patent
Hoshino et al.

(10) Patent No.: US 9,265,117 B2
(45) Date of Patent: Feb. 16, 2016

(54) LIGHT SOURCE APPARATUS AND METHOD FOR CONTROLLING SAME

(71) Applicant: CANON KABUSHIKI KAISHA, Tokyo (JP)

(72) Inventors: Hironobu Hoshino, Machida (JP); Masanao Kurita, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/262,678

(22) Filed: Apr. 25, 2014

(65) Prior Publication Data

US 2014/0327360 A1 Nov. 6, 2014

(30) Foreign Application Priority Data

May 1, 2013 (JP) ..... 2013-096365

(51) Int. Cl.
*H05B 33/08* (2006.01)

(52) U.S. Cl.
CPC ..... *H05B 33/0869* (2013.01)

(58) Field of Classification Search
USPC ..... 315/169.3, 151; 345/204, 206, 207, 345/690, 76, 77
See application file for complete search history.

(56) References Cited

U.S. PATENT DOCUMENTS

| | | | | |
|---|---|---|---|---|
| 7,876,395 | B2 * | 1/2011 | Ho | 349/64 |
| 8,177,379 | B2 * | 5/2012 | Peng et al. | 362/97.2 |
| 2009/0140656 | A1 * | 6/2009 | Kohashikawa et al. | 315/151 |

FOREIGN PATENT DOCUMENTS

| | | |
|---|---|---|
| JP | 2001-142409 A | 5/2001 |
| JP | 2011-027941 A | 2/2011 |

* cited by examiner

*Primary Examiner* — Minh D A
(74) *Attorney, Agent, or Firm* — Cowan, Liebowitz & Latman, P.C.

(57) ABSTRACT

The light source apparatus includes: a light source substrate having a light emission unit; an optical sheet facing the light emission unit; a plurality of detection units configured to detect light; and an adjustment unit configured to adjust light emission brightness of the light emission unit on the basis of detection values of two or more of the detection units, the two or more detection units including the detection unit arranged at a position at which a change in the detection value due to a deflection of the optical sheet is positive when the light emission unit emits the light and the detection unit arranged at a position at which the change in the detection value due to the deflection of the optical sheet is negative when the light emission unit emits the light.

15 Claims, 10 Drawing Sheets

FIG. 4

| PROCESSING ORDER | LIGHT EMISSION UNIT | ADJUSTMENT LIGHT SENSOR 1 | ADJUSTMENT LIGHT SENSOR 2 |
|---|---|---|---|
| 1 | 111(1,1,1) | 113(1,1,4) | 113(1,2,1) |
| 2 | 111(1,1,2) | 113(1,2,1) | 113(1,2,2) |
| 3 | 111(1,1,3) | 113(1,2,2) | 113(1,2,3) |
| 4 | 111(1,1,4) | 113(1,2,3) | 113(1,2,4) |
| 5 | 111(1,1,5) | 113(1,1,4) | 113(1,2,1) |
| 6 | 111(1,1,6) | 113(1,2,1) | 113(1,2,2) |
| 7 | 111(1,1,7) | 113(1,2,2) | 113(1,2,3) |
| 8 | 111(1,1,8) | 113(1,2,3) | 113(1,2,4) |
| 9 | 111(1,2,1) | 113(1,1,2) | 113(1,1,1) |
| 10 | 111(1,2,2) | 113(1,1,3) | 113(1,1,2) |
| 11 | 111(1,2,3) | 113(1,1,4) | 113(1,1,3) |
| 12 | 111(1,2,4) | 113(1,2,1) | 113(1,1,4) |
| 13 | 111(1,2,5) | 113(1,1,2) | 113(1,1,1) |
| 14 | 111(1,2,6) | 113(1,1,3) | 113(1,1,2) |
| 15 | 111(1,2,7) | 113(1,1,4) | 113(1,1,3) |
| 16 | 111(1,2,8) | 113(1,2,1) | 113(1,1,4) |
| 17 | 111(2,1,1) | 113(2,1,4) | 113(2,2,1) |
| 18 | 111(2,1,2) | 113(2,2,1) | 113(2,2,2) |
| 19 | 111(2,1,3) | 113(2,2,2) | 113(2,2,3) |
| 20 | 111(2,1,4) | 113(2,2,3) | 113(2,2,4) |
| 21 | 111(2,1,5) | 113(2,1,4) | 113(2,2,1) |
| 22 | 111(2,1,6) | 113(2,2,1) | 113(2,2,2) |
| 23 | 111(2,1,7) | 113(2,2,2) | 113(2,2,3) |
| 24 | 111(2,1,8) | 113(2,2,3) | 113(2,2,4) |
| 25 | 111(2,2,1) | 113(2,1,2) | 113(2,1,1) |
| 26 | 111(2,2,2) | 113(2,1,3) | 113(2,1,2) |
| 27 | 111(2,2,3) | 113(2,1,4) | 113(2,1,3) |
| 28 | 111(2,2,4) | 113(2,2,1) | 113(2,1,4) |
| 29 | 111(2,2,5) | 113(2,1,2) | 113(2,1,1) |
| 30 | 111(2,2,6) | 113(2,1,3) | 113(2,1,2) |
| 31 | 111(2,2,7) | 113(2,1,4) | 113(2,1,3) |
| 32 | 111(2,2,8) | 113(2,2,1) | 113(2,1,4) |

FIG. 6A
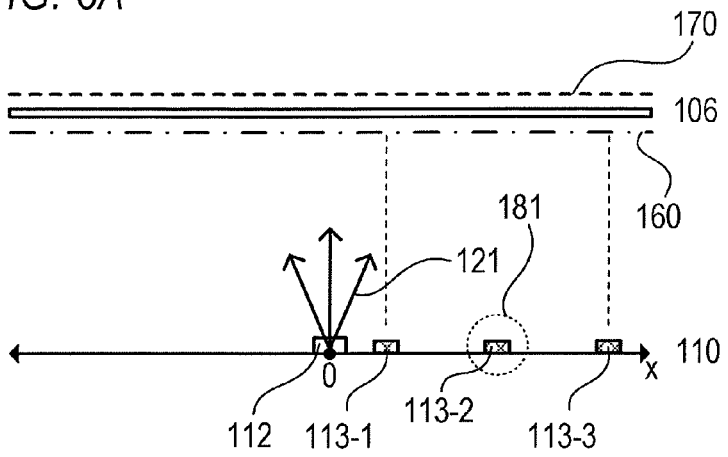
FIG. 6B
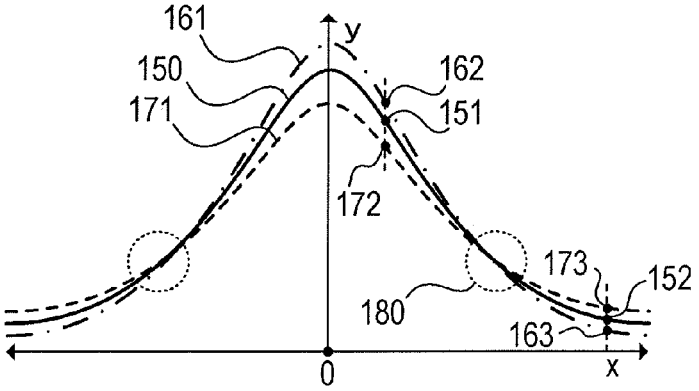
FIG. 6C
| LIGHT SENSOR | Rd VALUE | DETECTION VALUE |
|---|---|---|
| 113-1 | 3.04 | 304 |
| 113-3 | 4.03 | 403 |
| 113-2 | 3.54 | 354 (ESTIMATED DETECTION VALUE) |

LIGHT SOURCE APPARATUS AND METHOD FOR CONTROLLING SAME

BACKGROUND OF THE INVENTION

1. Field of the Invention

The present invention relates to a light source apparatus and a method for controlling the same.

2. Description of the Related Art

Color image display apparatuses have a color liquid crystal panel with a color filter and a light source apparatus (backlight apparatus) that projects white light onto the back surface of the color liquid crystal panel.

Conventionally, fluorescent lamps such as cold cathode fluorescent lamps (CCFLs) have been mainly used as the light sources of light source apparatuses. In recent years, however, light emitting diodes (LEDs) excellent in power consumption, service life, color reproducibility, and environmental load have become widespread as the light sources of the light source apparatuses.

In general, the light source apparatuses with the LEDs as their light sources (LED backlight apparatuses) have many LEDs. Japanese Patent Application Laid-open No. 2001-142409 discloses the LED backlight apparatus with a plurality of light emission units each having one or more LEDs. In addition, Japanese Patent Application Laid-open No. 2001-142409 discloses the control of brightness for each of the light emission units. With a reduction in the light emission brightness of the light emission units that project light to a region where a dark image is to be displayed in the screen of a color image display apparatus, power consumption is reduced and image contrast is enhanced. Such brightness control for each of the light emission units according to the characteristics of an image is called local dimming control.

The light source apparatuses suffer from a problem in which the light emission brightness of the light emission units is changed. The change in the light emission brightness is caused by, for example, a change in the light emission characteristics of the light sources due to a change in temperature, aging degradation in the light sources, or the like. In the light source apparatuses with the plurality of light emission units, the light emission brightness of the plurality of light emission units is fluctuated (caused to have brightness unevenness) with a fluctuation in the temperature or the aging degradation degree of the plurality of light emission units.

As a method for reducing the change in the light emission brightness and the brightness unevenness, there has been known a method for adjusting the light emission brightness of the light emission units using light sensors. Specifically, the method includes arranging the light sensors that detect light, which is reflected by the optical sheet (optical member) of the light source apparatuses and returned to the side of the light emission units, among light emitted from the light source apparatuses and adjusting the light emission brightness of the light emission units based on the detection values of the light sensors. In the light source apparatuses with the plurality of light emission units, the light emission units are turned on in a sequential order, and the reflected light is detected by the light sensors for each of the light emission units to adjust the light emission brightness. Such technology is disclosed in, for example, in Japanese Patent Application Laid-open No. 2011-27941.

SUMMARY OF THE INVENTION

However, when one of the light emission units is turned on, a brightness distribution on the surface of the optical sheet on the side of the light emission units is changed with the deflection of the optical sheet. Since such a change has not been taken into consideration in the related art, the detection values of the light sensors are largely fluctuated with the deflection of the optical sheet. As a result, the related art has difficulty in adjusting the light emission brightness of light emission units with high accuracy.

The present invention provides technology capable of adjusting the light emission brightness of light emission unit with high accuracy.

The present invention in its first aspect provides a light source apparatus, comprising:

a light source substrate having a light emission unit;

an optical sheet arranged at a position facing the light emission unit;

a plurality of detection units configured to detect light from the light emission unit; and an adjustment unit configured to adjust light emission brightness of the light emission unit on the basis of detection values of two or more of the detection units, the two or more detection units including the detection unit arranged at a position at which a change in the detection value due to a deflection of the optical sheet is positive when the light emission unit emits the light and the detection unit arranged at a position at which the change in the detection value due to the deflection of the optical sheet is negative when the light emission unit emits the light.

The present invention in its second aspect provides a light source apparatus, comprising:

a light source substrate having a light emission unit;

an optical sheet arranged at a position facing the light emission unit;

a plurality of detection units configured to detect light from the light emission unit; and an adjustment unit configured to adjust light emission brightness of the light emission unit on the basis of detection values of two or more of the detection units, the two or more detection units including the two detection units laid across a position facing a position on a surface of the optical sheet at which an amount of change of brightness on the surface of the optical sheet with a deflection of the optical sheet is a predetermined value or less when the light emission unit emits the light.

The present invention in its third aspect provides a light source apparatus, comprising:

a light source substrate having a light emission unit;

an optical sheet arranged at a position facing the light emission unit;

a plurality of detection units configured to detect light from the light emission unit; and an adjustment unit configured to adjust light emission brightness of the light emission unit on the basis of detection values of two or more of the detection units, the two or more detection units not including the detection unit closest to the light emission unit.

The present invention in its fourth aspect provides a method for controlling a light source apparatus including a light source substrate having a light emission unit, an optical sheet arranged at a position facing the light emission unit, and a plurality of detection units configured to detect light from the light emission unit, the method comprising:

acquiring detection values of the detection units; and adjusting light emission brightness of the light emission unit on the basis of the detection values of two or more of the detection units, the two or more detection units including the detection unit arranged at a position at which a change in the detection value due to a deflection of the optical sheet is positive when the light emission unit emits the light and the detection unit arranged at a position at which the change in the detection value due to the deflection of the optical sheet is negative when the light emission unit emits the light.

The present invention in its fifth aspect provides a method for controlling a light source apparatus including a light source substrate having alight emission unit, an optical sheet arranged at a position facing the light emission unit, and a plurality of detection units configured to detect light from the light emission unit, the method comprising:

acquiring detection values of the detection units; and adjusting light emission brightness of the light emission unit on the basis of the detection values of two or more of the detection units, the two or more detection units including the two detection units laid across a position facing a position on a surface of the optical sheet at which an amount of change of brightness on the surface of the optical sheet due to a deflection of the optical sheet is a predetermined value or less when the light emission unit emits the light.

The present invention in its sixth aspect provides a method for controlling a light source apparatus including a light source substrate having a light emission unit, an optical sheet arranged at a position facing the light emission unit, and a plurality of detection units configured to detect light from the light emission unit, the method comprising:

acquiring detection values of the detection units; and adjusting light emission brightness of the light emission unit on the basis of the detection values of two or more of the detection units, the two or more detection units not including the detection unit closest to the light emission unit.

According to the present invention, the light emission brightness of the light emission unit can be adjusted with high accuracy.

Further features of the present invention will become apparent from the following description of exemplary embodiments with reference to the attached drawings.

BRIEF DESCRIPTION OF THE DRAWINGS

FIG. 4 is a view showing an example of a corresponding table according to the embodiment;

FIGS. 6A to 6C are views each showing an example of the configuration of the light source apparatus and a brightness change with a deflection according to the embodiment;

DESCRIPTION OF THE EMBODIMENTS

Hereinafter, a description will be given of a light source apparatus according to an embodiment of the present invention. Note that although the embodiment describes an example of a case in which the light source apparatus is a backlight apparatus used in a color image di splay apparatus, the light source apparatus is not limited to the backlight apparatus used in the display apparatus. The light source apparatus may be, for example, alighting apparatus such as a street light, indoor lighting, and microscope lighting.

Figure 1A:
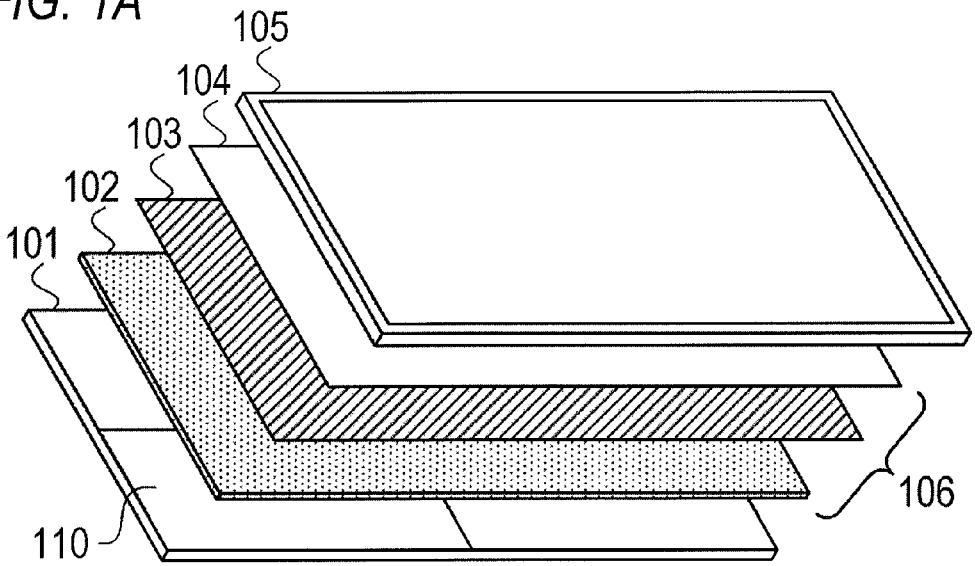
FIGS. 1A and 1B are views each showing an example of a light source apparatus according to an embodiment.

FIG. 1A is a schematic view showing a configuration example of a color image display apparatus according to the embodiment. The color image display apparatus has a backlight apparatus and a color liquid crystal panel 105. The backlight apparatus has a light source substrate 101, a diffusion plate 102, a condensing sheet 103, a reflective polarization film 104, or the like.

The light source substrate 101 emits light (white light) to be projected onto the back surface of the color liquid crystal panel 105. The light source substrate 101 has a plurality of light sources. As the light sources, light emitting diodes (LEDs), cold cathode fluorescent lamps, organic EL devices, or the like may be used.

The diffusion plate 102, the condensing sheet 103, and the reflective polarization film 104 are arranged parallel to the light source substrate and exert their optical change on the light from the light source substrate 101 (specifically, light emission units that will be described later).

Specifically, the diffusion plate 102 diffuses the light from the plurality of light sources (LED chips in the embodiment) to cause the light source substrate 101 to serve as a surface light source.

The condensing sheet 103 condenses the white light, which is diffused by the diffusion plate 102 and incident at various incident angles, into a front direction (on the side of the color liquid crystal panel 105) to enhance front brightness (brightness (luminance) in the front direction).

The reflective polarization film 104 efficiently polarizes the incident white light to enhance the front brightness.

The diffusion plate 102, the condensing sheet 103, and the reflective polarization film 104 are used in their overlapped state. In the following description, these optical members will be collectively called an optical sheet 106. Note that the optical sheet 106 may include members other than the above optical members or may include at least any one of the above optical members. In addition, the optical sheet 106 and the color liquid crystal panel 105 may be integrated with each other.

Each of the members of the optical sheet 106 is made of a thin resin with a thickness of about several hundred μm to several mm. Therefore, the optical sheet 106 is likely to change its shape (cause a deformation). For example, the optical sheet may cause a deformation of about several mm in the thickness direction. The deformation amount depends on the size, the thickness, and the material of the optical sheet. The deformation may be caused by various factors such as the fixation mechanism (retention mechanism), the aging, and the use environment (specifically, thermal expansion, static electricity, gravity according to the use environment) of the optical sheet. For example, when the optical sheet is substantially parallel to the ground, the deformation may be caused in the gravity direction by the gravity. Since the deformation is caused by the various factors as described above, it is difficult to exactly predict the deformation of the optical sheet 106 and prevent the deformation itself.

The color liquid crystal panel 105 has a plurality of pixels including R sub-pixels that cause red light to pass through, G sub-pixels that cause green light to pass through, and B sub-pixels that cause blue light to pass through, and controls the brightness of the emitted white light for each of the sub-pixels to display a color image.

The backlight apparatus with the above configuration (configuration shown in FIG. 1A) is generally called a direct type backlight apparatus.

Figure 1B:
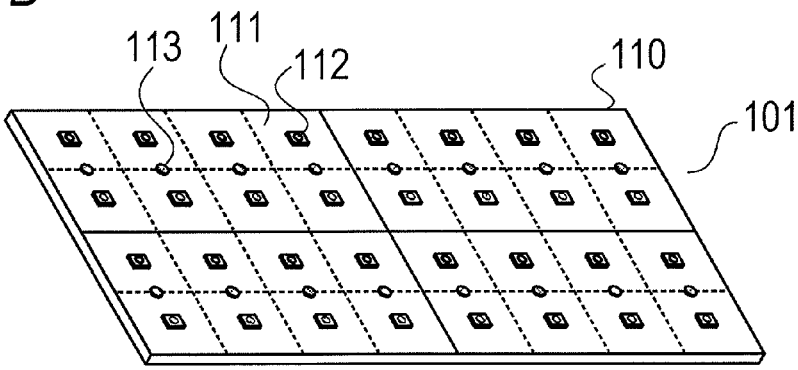

FIG. 1B is a schematic view showing a configuration example of the light source substrate 101.

The light source substrate 101 has a plurality of light emission units.

In the example of FIG. 1B, the light source substrate 101 has totally four LED substrates 110 of two rows×two columns arranged in a matrix form. Note that although the embodiment describes a case in which the light source substrate 101 has the plurality of LED substrates, the light source substrate 101 may have one LED substrate. For example, the four LED substrates shown in FIG. 1B may be replaced by one LED substrate.

Each of the LED substrates 110 has totally eight light emission units 111 of two rows×four columns. That is, the light source substrate 101 has totally 32 light emission units 111 of four rows×eight columns.

Each of the light emission units 111 has one light source (LED chip 112), and the light emission brightness of each of the light emission units 111 may be individually controlled. As the LED chips 112, white LEDs that emit white light may be, for example, used. It is also possible to use, as the LED chips 112, chips capable of providing white light using a plurality of LEDs (for example, red LEDs that emit red light, green LEDs that emit green light, and blue LEDs that emit blue light) each of which emits a different color of light.

Each of the LED substrates 110 has two or more light sensors 113 (detection units) that detect light and output a detection value. Some of the light from the light emission units 111 are reflected by the optical sheet and returned to the side of the light emission units. The light sensors 113 are arranged so as to face the optical sheet 106 and detect the light reflected by the optical sheet 106 and returned to the side of the light emission units. Based on the brightness of the reflected light, the light emission brightness of the light emission units 111 may be predicted. In the embodiment, the plurality of light sensors is arranged at different positions. In the example of FIG. 1B, four light sensors 113 are arranged in one LED substrate 110. Specifically, for every two light emission units 111, the light sensor 113 is arranged in the column direction of the LED substrate 110 between the light emission units 111. As the light sensors 113, sensors such as photodiodes and phototransistors that output brightness as a detection value may be used. It is also possible to use, as the light sensors 113, color sensors that output a color change or the like besides brightness.

Figure 2A:
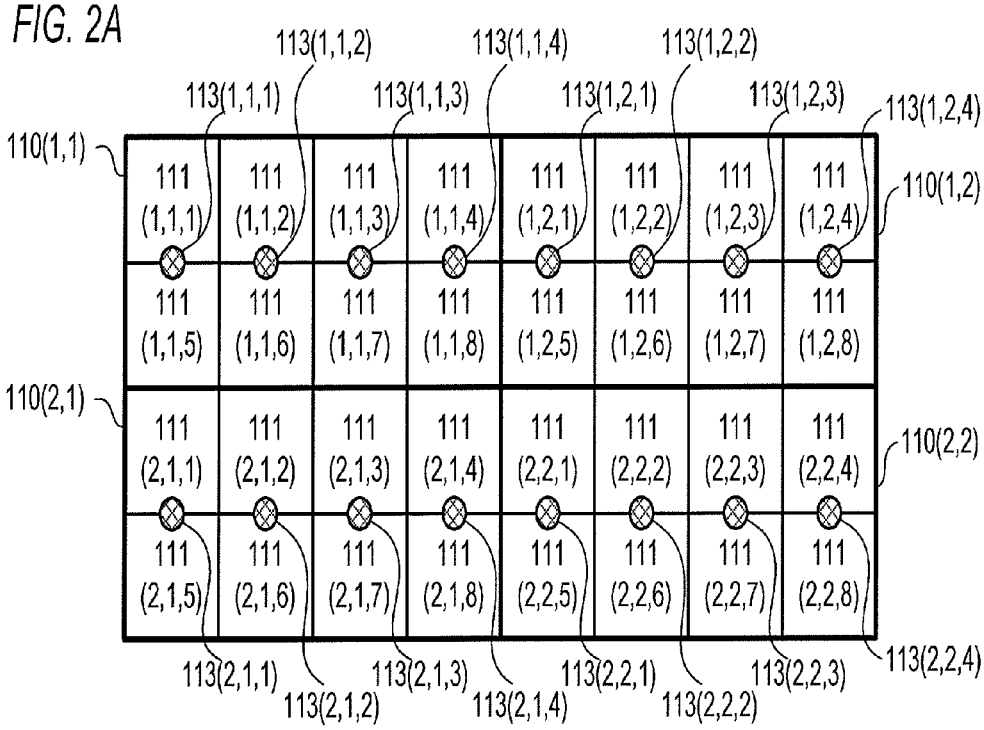
FIGS. 2A and 2B are views each showing an example of the light source apparatus according to the embodiment.

FIG. 2A is a schematic view showing an arrangement example of the LED substrates 110, the light emission units 111, and the light sensors 113 as seen from the front direction (the side of the color liquid crystal panel 105). On the right side of an LED substrate 110(1,1) arranged at an upper left end, an LED substrate 110(1,2) is adjacently arranged. On the lower side of the LED substrate 110(1,1), an LED substrate 110(2,1) is adjacently arranged. On the right side of the LED substrate 110(2,1), an LED substrate 110(2,2) is adjacently arranged.

An LED substrate 110(X,Y) (where X and Y=1 or 2) has eight light emission units 111(X,Y,Z1) (where Z1=1 to 8). For example, the LED substrate 110(1,1) has a light emission unit 111(1,1,1), a light emission unit 111(1,1,2), a light emission unit 111(1,1,3), a light emission unit 111(1,1,4), a light emission unit 111(1,1,5), a light emission unit 111(1,1,6), a light emission unit 111(1,1,7), and a light emission unit 111(1,1,8). Z1 is a value indicating the position of each of the light emission units 111. Of the eight light emission units 111(X,Y,Z1), the positions Z1 of the four light emission units in the first row are, respectively, indicated by 1, 2, 3, and 4 from the left end and that of the four light emission units in the second row are, respectively, indicated by 5, 6, 7, and 8 from the left end.

In addition, the LED substrate 110(X,Y) has four light sensors 113(X,Y,Z2) (where Z2=1 to 4). For example, the LED substrate 110(1,1) has a light sensor 113(1,1,1), a light sensor 113(1,1,2), a light sensor 113(1,1,3), and a light sensor 113(1,1,4). Z2 is a value indicating the position of each of the light sensors 113, and the positions of the light sensors are, respectively, indicated by 1, 2, 3, and 4 from the left end.

Figure 2B:
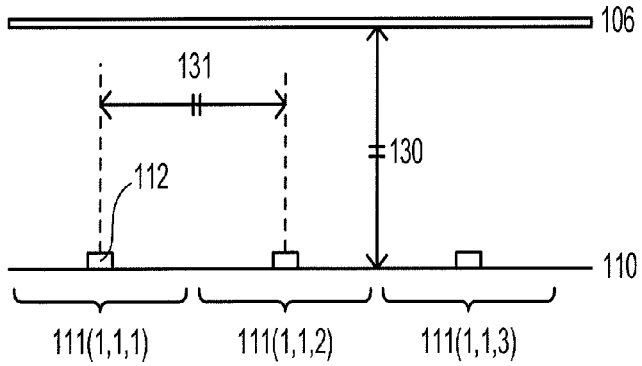

FIG. 2B is a cross-sectional view (cross-sectional view along a plane perpendicular to a screen) showing an arrangement example of the LED substrate 110 and the optical sheet 106.

Each of the light emission units 111 of the LED substrate 110 has one LED chip 112. The LED chips 112 are arranged at even intervals. The interval between the LED chips 112 is described as an LED pitch 131. The LED substrate 110 is arranged parallel to the optical sheet 106. The distance between the LED substrate 110 (the light emission units 111) and the optical sheet 106 is described as a diffusion distance 130. In a backlight apparatus using LED chips with general directivity, each member is arranged such that a diffusion distance becomes equal to or larger than an LED pitch, whereby the brightness unevenness of light after having passed through an optical sheet may be adequately reduced. In the embodiment, the LED pitch 131 is equal to the diffusion distance 130.

Figure 3:
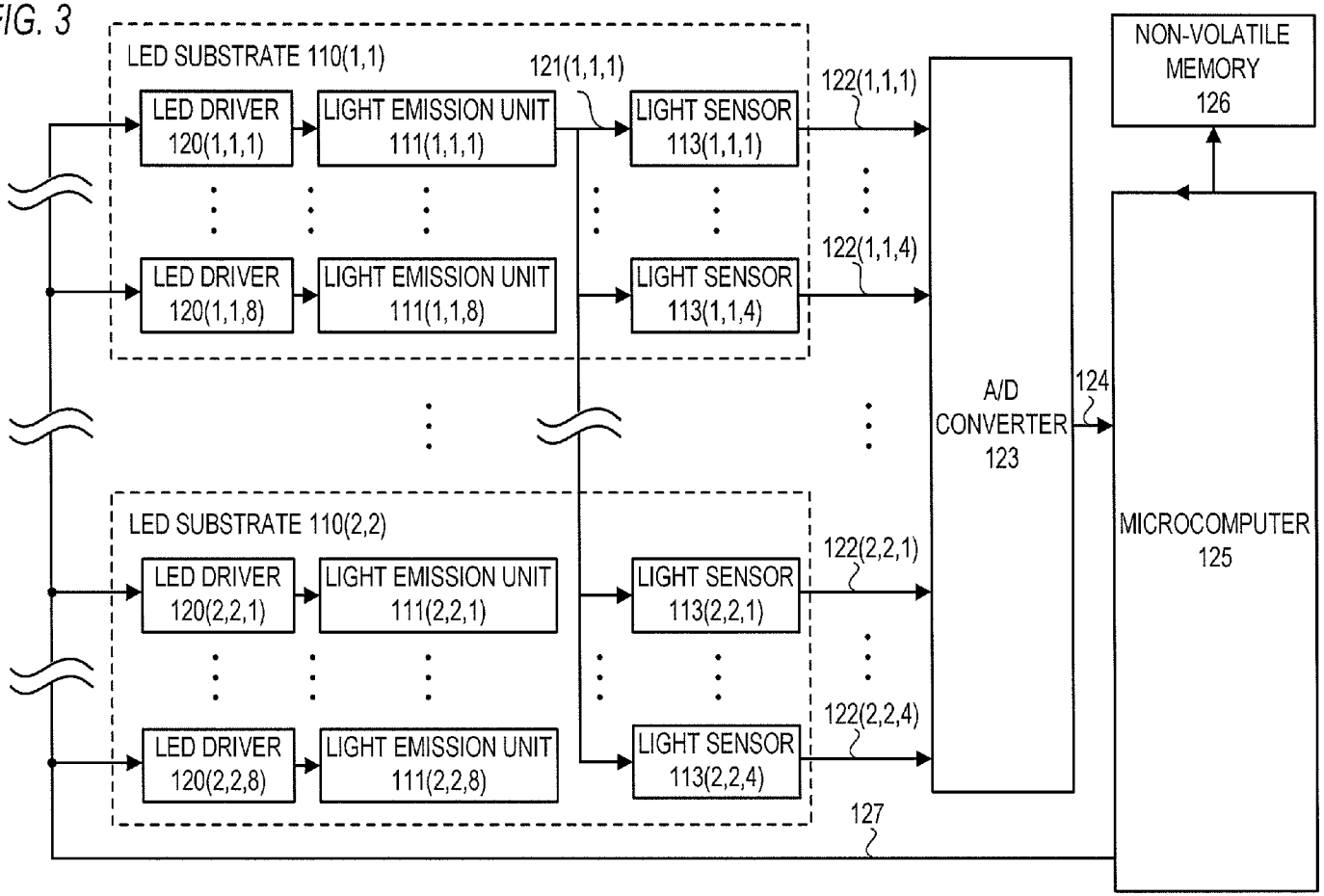
FIG. 3 is a block diagram showing an example of the light source apparatus according to the embodiment.

FIG. 3 is a block diagram showing a configuration example of the backlight apparatus.

Since the four LED substrates 110 have the same configuration, a description will be given of the LED substrate 110 (1,1) as an example. The LED substrate 110(1,1) has the light emission units 111(1,1,1) to 111(1,1,8). The light emission units 111(1,1,1) to 111(1,1,8) are driven by LED drivers 120(1,1,1) to 120(1,1,8), respectively.

In the embodiment, light emission brightness adjustment processing is performed periodically or at specific timing to reduce brightness unevenness caused by fluctuations in the temperature and the aging degradation degree between the light emission units 111. Although all the light emission units 111 are turned on in a normal operation, the light emission brightness adjustment processing causes the plurality of light emission units 111 to be turned on in a sequential order. Then, the light emission brightness of each of the light emission units 111 is adjusted using two or more of the light sensors 113. Specifically, the reflected light is detected using two or more of the light sensors 113, and an estimated detection value is estimated using the detection values of the two or more light sensors 113. Then, the light emission brightness of the light emission unit 111 is adjusted based on the estimated detection value. The estimated detection value is the detection value of a detection unit (light sensor) assumed to be arranged at a certain position.

FIG. 3 shows a state in which the light emission unit 111 (1,1,1) is turned on when the detection value used to adjust the light emission brightness of the light emission unit 111(1,1,1) is obtained. In FIG. 3, the light emission unit 111(1,1,1) is turned on, and the other light emission units 111 are turned off. Light 121(1,1,1) emitted from the light emission unit 111(1,1,1) is mostly incident on the color liquid crystal panel 105 (not shown in FIG. 3). However, some of the light are returned from the optical sheet 106 (not shown in FIG. 3) to the side of the light emission unit as reflected light and incident on each of the light sensors 113. Based on the brightness of the reflected light thus detected, each of the light sensors 113 outputs an analog value 122 (detection value) expressing the brightness. From among the analog values 122 output from the respective light sensors 113, an A/D converter 123 selects the analog values output from two or more of the light sensors 113 associated in advance with the light emission unit 111(1,1,1). In the embodiment, the light sensor 113(1,2,1) and the light sensor 113(1,1,4) are associated with the light emission unit 111(1,1,1). Therefore, an analog value 122(1,2,1) output from the light sensor 113(1,2,1) and an analog value 122(1,1,4) output from the light sensor 113(1,1,4) are selected. The A/D converter 123 performs analog-to-digital conversion to convert the selected analog values into digital values. Then, the A/D converter 123 outputs digital values 124 (the digital value obtained by converting the analog value 122(1,2,1) and the digital value obtained by converting the analog value 122(1,1,4)) to a microcomputer 125. The light sensors 113 associated in advance with the light emission units 111 are used to adjust the light emission brightness of the light emission units 111. For this reason, the light sensors will be described as adjustment light sensors below.

When one of the light emission units is turned on, a brightness distribution on the side of the light emission units on the surface of the optical sheet is changed with the deflection of the optical sheet (the surface on the side of the light emission units of the optical sheet will be described as a back surface). In the embodiment, since the light sensor 113(1,2,1) and the light sensor 113(1,1,4) are used to adjust the light emission brightness of the light emission unit 111(1,1,1), the estimated detection value that is less changed with the deflection of the optical sheet may be obtained. As a result, the light emission brightness of the light emission unit may be adjusted with high accuracy. The reason why such an effect may be produced will be described in detail below.

The same processing is also performed on the other light emission units 111. That is, in a state in which only the light emission unit 111 to be processed is turned on, the reflected light is detected by each of the light sensors 113. Then, the A/D converter 123 converts the analog values 122, which are output from two or more of the light sensors 113 associated in advance with the light emission unit 111 whose light emission brightness is to be adjusted, into the digital values 124 and outputs the digital values 124 to the microcomputer 125. In the embodiment, two of the light sensors are associated with each of the light emission units. Therefore, the A/D converter 123 outputs totally 64 detection values (the detection values of the light sensors, i.e., the digital values 124) to the microcomputer 125.

The microcomputer 125 estimates the estimated detection value using the detection values (specifically, the digital values 124) of two or more of the adjustment light sensors 113. Then, the microcomputer 125 adjusts the light emission brightness of each of the light emission units 111 based on the estimated detection value. In the embodiment, the microcomputer 125 performs the processing for estimating the estimated detection value and adjusting the light emission brightness of each of the light emission units. Specifically, the microcomputer 125 retains, in a non-volatile memory 126, a target brightness value (target value of the estimated detection value) for each of the light emission units 111 set at a manufacturing and inspecting time or the like of the color image display apparatus. The microcomputer 125 estimates the estimated detection value from the detection values of two or more of the adjustment light sensors 113 and compares the estimated detection value with the target value for each of the light emission units 111. Then, based on the result of the comparison, the microcomputer 125 adjusts the light emission brightness such that the estimated detection value becomes equal to the target value for each of the light emission units 111. For example, the light emission brightness is adjusted in such a way that an LED driver control signal 127 output from the microcomputer 125 to each of the LED drivers 120 is adjusted. Based on the LED driver control signal, each of the LED drivers 120 drives each of the light emission units 111. The LED driver control signal expresses, for example, the pulse width of a pulse signal (pulse signal of current or voltage) applied to each of the light emission units 111. In this case, the light emission brightness of each of the light emission units 111 is PWM-controlled by the adjustment of the LED driver control signal. Note that the LED driver control signal is not limited to the above. For example, the LED driver control signal may include the pulse height value of a pulse signal applied to each of the light emission units 111 or may include both a pulse width and a pulse height value. The light emission brightness of each of the light emission units 111 is adjusted such that the estimated detection value becomes equal to the target value, whereby the brightness unevenness of the whole backlight apparatus may be reduced.

FIG. 4 is a correspondence table showing an example of the processing order of the plurality of light emission units 111 and the corresponding relationship between the light emission units 111 and the adjustment light sensors. The above processing (processing for acquiring the detection value and outputting the same to the microcomputer 125) is performed 32 times corresponding to the number of the light emission units 111.

In the first processing, the light emission unit 111(1,1,1) is turned on, and the other light emission units 111 are turned off. Then, the light sensor 113(1,2,1) and the light sensor 113(1,1,4) are selected as the adjustment light sensors, and the detection values of these sensors are output to the microcomputer 125.

Figure 5A:
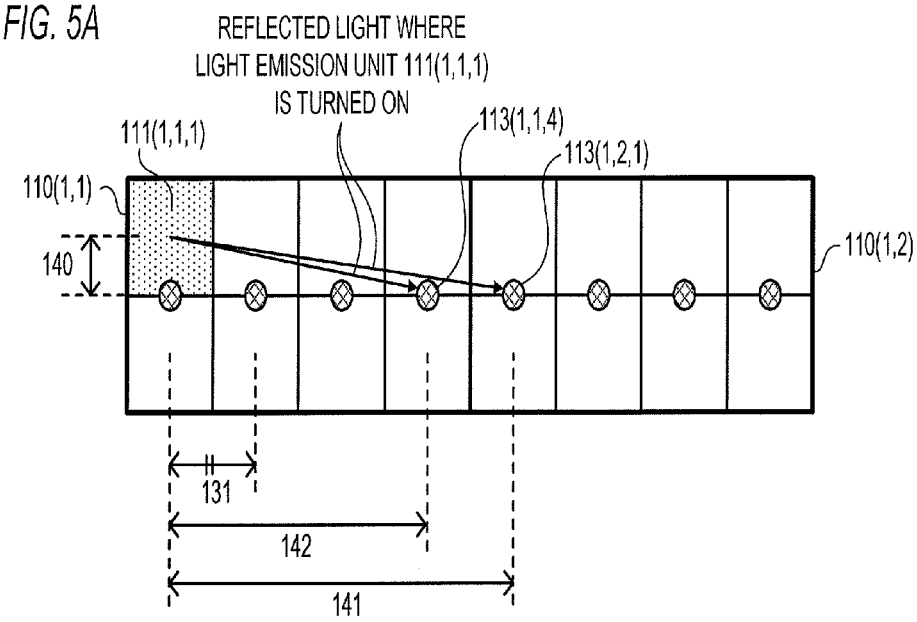
FIGS. 5A and 5B are views each showing an example of the positional relationship between a light emission unit and adjustment light sensors according to the embodiment.

FIG. 5A is a schematic view showing the positional relationship between the light emission unit 111(1,1,1), the light sensor 113(1,1,4), and the light sensor 113(1,2,1) as seen from the front direction (from the side of the color liquid crystal panel 105). In the embodiment, in order to adjust the light emission brightness of the light emission unit 111(1,1,1), the light sensor 113(1,1,1) arranged closest to the light emission unit 111(1,1,1) is not used but the light sensor 113(1,1,4) and the light sensor 113(1,2,1) arranged at positions relatively distant from the light emission unit 111(1,1,1) are used. A vertical distance 140 is 0.5 times as large as the LED pitch 131, and a horizontal distance 142 is three times as large as the LED pitch 131. Therefore, it is found from the Pythagorean theorem that the distance between the light emission center of the light emission unit 111(1,1,1) and the light sensor 113(1,1,4) is 3.04 times as large as the LED pitch 131. Similarly, since a horizontal distance 141 is four times as large as the LED pitch 131, it is found from the Pythagorean theorem that the distance between the light emission center of the light emission unit 111(1,1,1) and the light sensor 113(1,2,1) is 4.03 times as large as the LED pitch 131. In the embodiment, since the LED pitch 131 is equal to the diffusion distance 130, it is found that the distance between the light emission center of the light emission unit 111(1,1,1) and the light sensor 113(1,1,4) is 3.04 times as large as the diffusion distance 130. In addition, it is found that the distance between the light emission center of the light emission unit 111(1,1,1) and the light sensor 113(1,2,1) is 4.03 times as large as the diffusion distance 130.

As shown in FIG. 4, in the second processing, the light emission unit 111(1,1,2) is turned on, and the other light emission units 111 are turned off. Then, the light sensor 113(1,2,1) and the light sensor 113(1,2,2) are selected as the adjustment light sensors, and the detection values of the light sensor 113(1,2,1) and the light sensor 113(1,2,2) are output to the microcomputer 125.

Figure 5B:
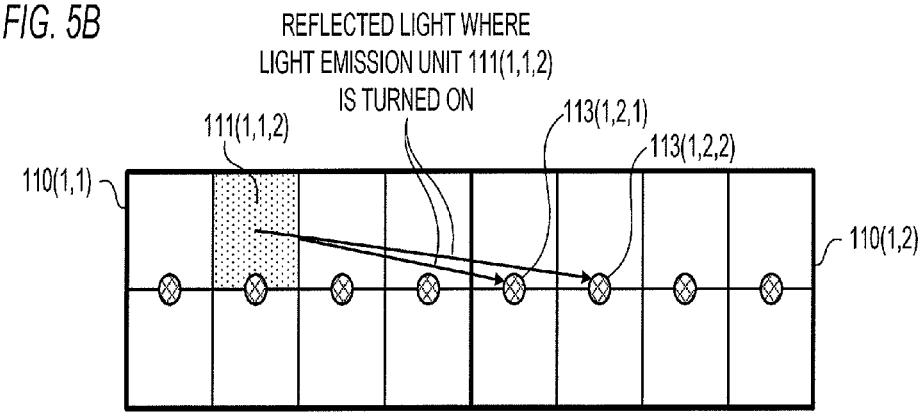

FIG. 5B is a schematic view showing the positional relationship between the light emission unit 111(1,1,2), the light sensor 113(1,2,1), and the light sensor 113(1,2,2) as seen from the front direction (from the side of the color liquid crystal panel 105). Like the first processing, the distance between the light emission center of the light emission unit 111(1,1,2) and the light sensor 113(1,2,1) is 3.04 times as large as the diffusion distance 130. In addition, the distance between the light emission center of the light emission unit 111(1,1,2) and the light sensor 113(1,2,2) is 4.03 times as large as the diffusion distance 130.

The processing subsequent to the third processing is performed in the same way in the order shown in the correspondence table of FIG. 4. Note that also in the processing subsequent to the third processing, the distances between the light emission units 111 to be processed and the two adjustment light sensors are, respectively, 3.04 and 4.03 times as large as the diffusion distance 130.

In the following description, the ratio of the distance between the light emission center of each of the light emission units 111 and each of the light sensors to the diffusion distance 130 will be described as Rd.

Next, a description will be given of the reason why the estimated detection value that is less changed with the deflection of the optical sheet 106 may be obtained with the estimation of the detection value of the light sensor assumed to be arranged at (or near) the position where Rd=3.54 as the estimated detection value.

FIG. 6A is a schematic view showing an example of the positional relationship between the LED chip 112, the light sensors 113-1 to 113-3, the LED substrate 110, and the optical sheet 106. The LED substrate 110 is arranged parallel to the optical sheet 106. The LED chip 112 is arranged on the LED substrate 110 with the light emission surface thereof directed to the side of the optical sheet 106 (in the direction of the optical sheet among the directions perpendicular to the light source substrate). When the LED chip 112 is turned on, the light 121 from the LED chip 112 is diffused to the side of the optical sheet 106. Light emitted from a general LED has directivity in which the intensity distribution is substantially a Lambert distribution and shows the highest intensity in a direction perpendicular to the light emission surface of the LED.

Figure 7:
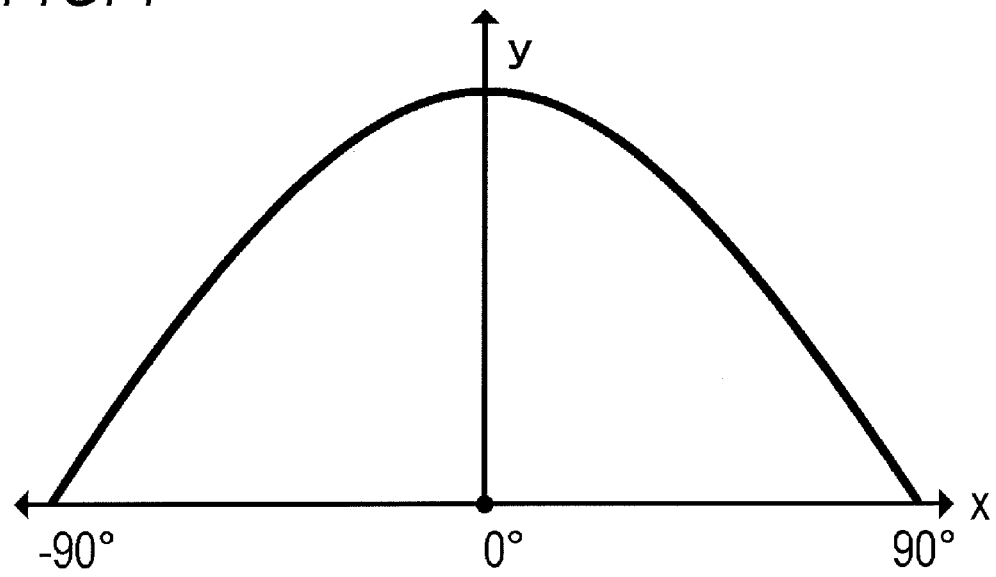
FIG. 7 is a graph showing an example of the light emission brightness distribution of the light emission unit.

FIG. 7 is a graph showing an example of the relationship between an angle θ with respect to the direction perpendicular to the light emission surface of the LED chip 112 and the intensity (light emission intensity) of the light emitted from the LED chip 112. FIG. 7 shows an example of a case in which the light emission intensity distribution of the LED chip 112 is a Lambert distribution. In FIG. 7, the y axis shows the light emission intensity, and the x axis shows the angle θ. As shown in FIG. 7, the Lambert distribution has the relationship in which the light emission intensity=cos θ. Here, the light emission intensity becomes the highest where the angle θ=0° and becomes zero where the angle θ=±90°.

FIG. 6B is a graph showing an example of a brightness distribution on the back surface of the optical sheet 106 in a case in which only one of the LED chips 112 (only one of the light emission units) is turned on. In FIG. 6B, the y axis shows brightness, and the x axis shows a position on the optical sheet 106. Specifically, the x axis shows a distance from a position facing the LED chip 112. The brightness on the back surface of the optical sheet 106 is determined based on the sum of light directly incident from the LED chip 112 (a direct incident amount) and light incident after being repeatedly reflected between the optical sheet 106 and the LED substrate 110 (an indirect incident amount). The brightness distribution on the back surface of the optical sheet 106 draws a curve 150 in which the brightness becomes the maximum at x=0 (the position right above the LED chip 112) and reduces with a distance from the position where x=0. The curve 150 shows the brightness distribution in a case in which the optical sheet 106 is not deflected.

Here, as shown in FIG. 6A, it is assumed that the light sensors 113-1 to 113-3 are arranged on the LED substrate 110 with the detection surfaces thereof directed to the side of the optical sheet 106 (in the direction of the optical sheet among the directions perpendicular to the light source substrate). The light sensors 113-1 and 113-3 are the adjustment light sensors associated with the LED chip 112 (light emission unit). The light sensor 113-1 is arranged at the position where Rd=3.04, and the light sensor 113-3 is arranged at the position where Rd=4.03. In this case, the light sensor 113-1 detects the brightness corresponding to brightness 151 at the position facing the light sensor 113-1 in the brightness distribution of FIG. 6B. In addition, the light sensor 113-3 detects the brightness corresponding to brightness 152 at the position facing the light sensor 113-3 in the brightness distribution of FIG. 6B. In order to maximize an S/N ratio in the detection values of the light sensors, it is necessary to bring the light sensors closer to the LED chip 112 as much as possible and receive a greater amount of light. For this reason, in the related art, the light sensor closest to the LED chip 112 is used as the adjustment sensor.

Figure 8:
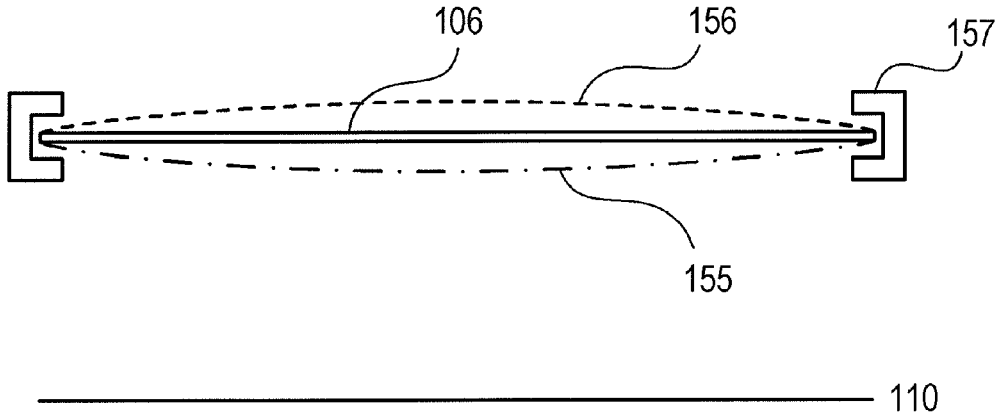
FIG. 8 is a graph showing an example of the deflection of an optical sheet.

FIG. 8 is a cross-sectional view showing an example of a deflection caused in the optical sheet 106. The optical sheet 106 is fixed by an optical sheet fixation member 157 at the surrounding part thereof. However, due to factors such as the fixation mechanism (retention mechanism), the aging, and the use environment (specifically, thermal expansion, static electricity, gravity according to the use environment) of the optical sheet, the amount of the deflection caused in the optical sheet 106 is larger toward the central part of the optical sheet 106 and smaller toward the peripheral part thereof. The deflection includes a deflection 155 in a negative direction in which the whole optical sheet 106 approaches the LED substrate 110 and a deflection 156 in a positive direction in which the whole optical sheet 106 is distant from the LED substrate 110. Although local deflections or waves are likely to be caused besides these deflections, either the deflection 155 in the negative direction or the deflection 156 in the positive direction is generally dominant.

A dashed line 160 in FIG. 6A shows the position of the optical sheet 106 deflected in the negative direction. When being deflected in the negative direction, the optical sheet 106 approaches the LED substrate 110 so as to keep its parallel relationship with the LED substrate 110. As shown in the cross-sectional view of FIG. 8, the amount of the deflection essentially becomes larger toward the central part of the optical sheet 106. However, from a micro point of view only at the periphery of the LED chip 112, there is no problem to believe that the parallel relationship between the optical sheet 106 and the LED substrate 110 is kept.

A dashed line 161 in FIG. 6B shows a brightness distribution on the back surface of the optical sheet 106 deflected in the negative direction. The curve 161 shows the brightness higher than that of the curve 150 at positions near the position facing the LED chip 112 (near the position where x=0) and shows the brightness lower than that of the curve 150 at positions distant from the LED chip 112. This is because the diffusion of the light from the LED chip 112 (the diffusion of the light until reaching the optical sheet 106) is reduced when the optical sheet 106 approaches the LED chip 112. With the reduction in the diffusion of the light from the LED chip 112, the light 121 is focused on the position facing the LED chip 112 and hardly reaches the positions distant from the position facing the LED chip 112.

When the optical sheet 106 is positioned at the dashed line 160, higher brightness is detected at positions near the LED chip 112 (near the position where x=0) compared with a case in which the optical sheet 106 is not deflected (the change in the detection value with the deflection of the optical sheet becomes positive). On the other hand, lower brightness is detected at positions distant from the LED chip 112 compared with a case in which the optical sheet 106 is not deflected (the change in the detection value with the deflection of the optical sheet becomes negative). Specifically, the light sensor 113-1 detects the brightness corresponding to brightness 162 (i.e., the brightness 162 at the position facing the light sensor 113-1 in the brightness distribution 161 of FIG. 6B) higher than the brightness 151. On the other hand, the light sensor 113-3 detects the brightness corresponding to brightness 163 (i.e., the brightness 163 at the position facing the light sensor 113-3 in the brightness distribution 161 of FIG. 6B) lower than the brightness 152. That is, since the brightness distribution on the back surface of the optical sheet is changed with the deflection of the optical sheet, the change amount of the detection value of each of the light sensors with the deflection of the optical sheet is changed with the distance between the light emission center of the light emission unit and each of the light sensors. Since each of the light sensors is essentially intended to detect the change in the brightness due to temperature and aging degradation, the change in the brightness caused by the deflection of the optical sheet 106 as described above is a detection error.

A broken line 170 in FIG. 6A shows the position of the optical sheet 106 deflected in the positive direction. When being deflected in the positive direction, the optical sheet 106 is distant from the LED substrate 110 so as to keep its parallel relationship with the LED substrate 110.

A broken line 171 in FIG. 6B shows a brightness distribution on the back surface of the optical sheet 106 deflected in the positive direction. The curve 171 shows the brightness lower than that of the curve 150 at positions near the position facing the LED chip 112 (near the position where x=0) and shows the brightness higher than that of the curve 150 at positions facing the LED chip 112. This is because the diffusion of the light from the LED chip 112 is more increased as the optical sheet 106 is distant from the LED chip 112. With the increase in the diffusion of the light from the LED chip 112, the light 121 is hardly focused on the position facing the LED chip 112 and easily reaches the positions distant from the position facing the LED chip 112.

When the optical sheet 106 is positioned at the broken line 170, lower brightness is detected at positions near the LED chip 112 (near the position where x=0) compared with the case in which the optical sheet 106 is not deflected. On the other hand, higher brightness is detected at positions distant from the LED chip 112 compared with the case in which the optical sheet 106 is not deflected. Specifically, the light sensor 113-1 detects the brightness corresponding to brightness 172 (i.e., the brightness 172 at the position facing the light sensor 113-1 in the brightness distribution 171 of FIG. 6B) lower than the brightness 151. On the other hand, the light sensor 113-3 detects the brightness corresponding to brightness 173 (i.e., the brightness 173 at the position facing the light sensor 113-3 in the brightness distribution 171 of FIG. 6B) higher than the brightness 152. Like the case in which the optical sheet 106 is deflected in the negative direction, such a change in the brightness is a detection error.

FIG. 6B shows the existence of a position 180 at which the curve 150, the curve 161, and the curve 171 agree with each other (the position at which the change in the brightness with the deflection of the optical sheet becomes zero, i.e., the zero cross point of the curves). Specifically, the position facing the position where Rd=3.54 is the zero cross point. Accordingly, if a light sensor 113-2 is assumed to be used as the adjustment sensor, the detection value that is less changed with the deflection of the optical sheet may be obtained. The light sensor 113-2 is arranged so as to face the position near the position corresponding to the zero cross point on the back surface of the optical sheet. In other words, the light sensor 113-2 is arranged so as to face the position on the back surface of the optical sheet at which the absolute value of the change amount of the brightness with the deflection of the optical sheet is a predetermined value or less. However, there are various physical restrictions on the arrangement of each of the light sensors 113 on the LED substrate 110. For example, it may be impossible to arrange each of the light sensors 113 at a position at which the installation of wiring is not allowed. Therefore, it is difficult to arrange each of the light sensors at an ideal position (desired position).

In the embodiment, using the detection values of two or more of the light sensors, the detection value of the light sensor assumed to be arranged so as to face the position near the zero cross point is estimated as the estimated detection value. That is, using the detection values of the two or more light sensors, the detection value of the light sensor assumed to be arranged so as to face the position on the back surface of the optical sheet at which the absolute value of the change amount of the brightness with the deflection of the optical sheet is a predetermined value or less is estimated as the estimated detection value.

Specifically, in the embodiment, each of the light emission units is, as shown in FIG. 4, associated with two of the light sensors each laid across a position facing a position on the back surface at which the absolute value of the change amount of the brightness with the deflection of the optical sheet is a predetermined value or less when only the light emission unit is turned on. In other words, each of the light emission units is associated with the two light sensors arranged at positions near and distant from the light emission unit, based on the position on the back surface at which the absolute value of the change amount of the brightness with the deflection of the optical sheet is the predetermined value or less when only the light emission unit is turned on. Then, using the detection values of the two associated light sensors, the detection value of the light sensor assumed to be arranged so as to correspond to the position near the zero cross point when only the light emission unit is turned on is estimated as the estimated detection value for each of the light emission units. For example, using the detection values of the light sensors 113-1 and 113-2 in a case in which the LED chip 112 is turned on, the detection value of the light sensor 113-2 that is not actually arranged is estimated as the estimated detection value.

Accordingly, the detection value in which the detection error (the change in the detection value) with the deflection of the optical sheet 106 is small may be obtained as the estimated detection value. Then, with the adjustment of the light emission brightness of the light emission unit using such an estimated detection value, it is possible to adjust the light emission brightness of the light emission unit with high accuracy.

A method for estimating the estimated detection value will be described with reference to FIG. 6C. Specifically, a description will be given of the method for estimating the detection value (estimated detection value) of the light sensor 113-2 actually not arranged from the detection values of the light sensors 113-1 and 113-3. FIG. 6C shows, for each of the light sensors, the distance between the light emission unit and the light sensor and the detection value. Specifically, for each of the light sensors, an Rd value (ratio of the distance between the light emission center of the light emission unit and the light sensor to the diffusion distance) is shown as the distance between the light emission unit and the light sensor.

In the embodiment, the detection values of the two adjustment light sensors are weighted and added with weights according to the distances between the light emission unit and the light sensors to estimate (calculate) the estimated detection value. Specifically, the estimated detection value is calculated from the detection values of the two adjustment light sensors based on linear interpolation. A formula for calculating the estimated detection value based on the linear interpolation is as follows. In the following formula, D1 stands for the detection value of the light sensor near the light emission unit, D3 stands for the detection value of the light sensor distant from the light emission unit, and D2 stands for the estimated detection value. In addition, Rd1 stands for the Rd value of the light sensor near the light emission unit, Rd3 stands for the Rd value of the light sensor distant from the light emission unit, and Rd2 stands for the Rd value of the light sensor (imaginary light sensor) capable of detecting the estimated detection value.

$$D2=D1+(D3-D1)/(Rd3-Rd1)\times(Rd2-Rd1)$$

As shown in FIG. 6C, Rd1=3.04, Rd3=4.03, Rd2=3.54, D1=304, and D3=403 are set. Therefore, the estimated detection value D2 (the detection value of the light sensor 113-2)= 304+(403−304)/(4.03−3.04)×(3.54−3.04)=354 is calculated.

Note that although the embodiment describes the example of the case in which the estimated detection value is calculated from the detection values of the two adjustment light sensors, it may be calculated from the detection values of two or more of the adjustment light sensors. For example, the detection values of two or more of the adjustment light sensors (for example, three or four of the light sensors) may be weighted and added with weights according to the distances between the light emission unit and the light sensors to calculate the estimated detection value.

Note that although the embodiment describes the example of the case in which the linear interpolation is used, interpolation other than the linear interpolation is available. For example, the interpolation may be non-linear interpolation (interpolation using a higher order polynomial). In addition, although the embodiment describes the example of the case in which the estimated detection value (the example of the case in which the weights are calculated from the Rd values) is calculated using the Rd values, it may be calculated using other methods. For example, the estimated detection value may be calculated using the distances themselves between the light emission unit and the light sensors. That is, the weights may be calculated from the distances themselves. In addition, the weights are not calculated but may be determined based on a table expressing the relationship between the distances and the weights.

Note that although the embodiment describes the example of the case in which the detection values of the two or more adjustment light sensors are weighted and added with the weights according to the distances between the light emission unit and the light sensors to calculate the estimated detection value, other methods may be used to calculate the estimated detection value. That is, any method may be used so long as it is capable of estimating the estimated detection value.

Note that the arrangement position of each of the light sensors 113 is not limited to a position on the LED substrate 110. For example, each of the light sensors 113 may be arranged in a hole formed in the LED substrate 110 or may be arranged at a position distant from the LED substrate 110.

Note that DICOM part 14 is used as the standard of display performance in medical image display apparatuses that require high accuracy. According to the DICOM part 14, it is required that the detection value of a photometer used to correct display brightness be within 3% of absolute brightness (Digital Imaging and Communications in Medicine (DICOM) Part 14: see Grayscale Standard Display Function). With the use of a photometer (i.e., a light sensor) satisfying such accuracy, it is possible to reduce an error in display brightness to a level at which a user does not recognize the error. Therefore, it is preferable to estimate, as the estimated detection value, the detection value of the light sensor assumed to be arranged so as to face a position on the back surface of an optical sheet at which the brightness ratio of the optical sheet before and after being deflected is 97% or more and 103% or less. The brightness ratio is the ratio of the brightness of the optical sheet that is deflected to the brightness of the optical sheet that is not deflected. With the estimation of such an estimated detection value, it is possible to obtain, as the estimated detection value, the detection value that is less changed with the deflection of the optical sheet and adjust the light emission brightness of a light emission unit with higher accuracy.

Next, a description will be given of the relationship between the change amount of the brightness on the back surface of the optical sheet 106 and the Rd (the ratio of the distance between the light emission center of the light emission unit 111 and the light sensor 113 to the diffusion distance 130).

Figure 9:
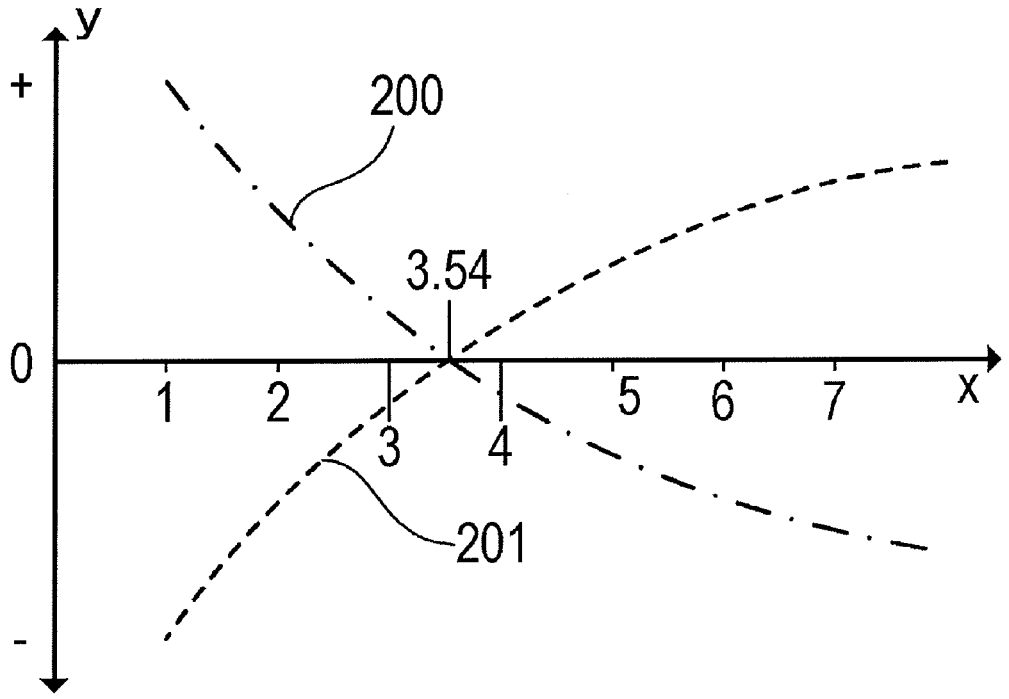
FIG. 9 is a graph showing an example of the relationship between the change amount of brightness with the deflection of the optical sheet and Rd.

FIG. 9 shows an example of a case in which the light emission intensity distribution of the light emission unit (LED chip) is substantially a Lambert distribution (a case in which the light emission intensity complies with cos θ). FIG. 9 also shows an example of a case in which the LED pitch 131 is equal to the diffusion distance 130. In FIG. 9, the x axis shows the Rd, and the y axis shows the change amount of the brightness (the brightness on the back surface of the optical sheet) with the deflection of the optical sheet. A curve 200 shows the change amount of the brightness in a case in which the optical sheet 106 is deflected in the negative direction. A curve 201 shows the change amount of the brightness in a case in which the optical sheet 106 is deflected in the positive direction.

From FIG. 9, it is found that the change amount of the brightness with the deflection of the optical sheet becomes larger toward the position facing the LED chip 112 (the position on the optical sheet facing the position where Rd=0). In addition, it is found that the position on the optical sheet facing the position where Rd=3.54 is the zero cross point and the change amount of the brightness becomes larger when the Rd exceeds the zero cross point.

When the detection surface of the light sensor 113 is directed to the side of the optical sheet 106 (in the direction of the optical sheet among the directions perpendicular to the light source substrate), the y axis shows the detection error of the light sensor 113.

Accordingly, when the light emission intensity distribution is substantially a Lambert distribution, it is preferable that the position for estimating the estimated detection value used to adjust the light emission brightness of the light emission unit be distant from the light emission center of the light emission unit by the distance 3.54 times as large as the distance between the light emission unit and the optical sheet. Thus, it is possible to obtain the estimated detection value that is less changed with the deflection of the optical sheet.

From the above reason, in the embodiment, the distance between the light emission unit 111 to be processed and the position for deriving the estimated detection value is set to be 3.54 times as large as the diffusion distance 130. Thus, it is possible to obtain the estimated detection value that is less changed with the deflection of the optical sheet.

Figure 10A:
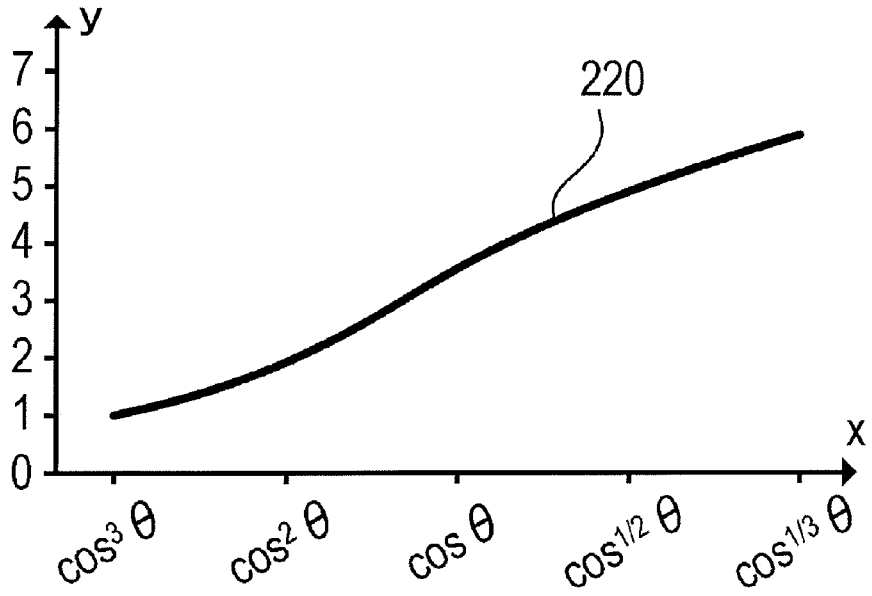
FIGS. 10A and 10B are graphs each showing an example of the relationship between the directivity of light from the light emission unit and a zero cross point.
Figure 10B:
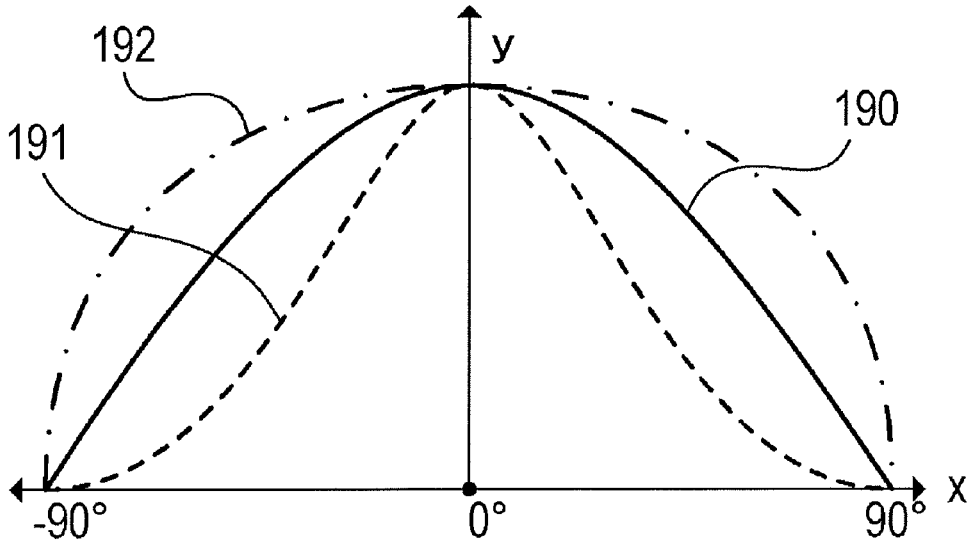

FIG. 10A is a graph showing an example of the relationship between the directivity of the light from the light emission unit (LED chip) and the Rd expressing the position facing the zero cross point. In FIG. 10A, the x axis shows the directivity, and the y axis shows the Rd at the position facing the zero cross point. FIG. 10B is a graph showing an example of the relationship between the directivity of the light from the light emission unit (LED chip) and the light emission intensity distribution. In FIG. 10B, the x axis shows an angle in the direction of the optical sheet among the directions perpendicular to the light source substrate, and the y axis shows the light emission brightness at a position distant by a predetermined distance in the direction of the optical sheet among the directions perpendicular to the light source substrate.

In a case in which the light emission intensity distribution of the light emission unit is a Lambert distribution (the light emission intensity complies with $\cos\theta$, i.e., the light emission intensity distribution is expressed by a curve 190 in FIG. 10B), the Rd at the position facing the zero cross point becomes 3.54. On the other hand, in a case in which the directivity of the light from the light emission unit is high (for example, the light emission intensity complies $\cos 3\theta$, i.e., the light emission intensity distribution is expressed by a curve 191 in FIG. 10B), the Rd at the position facing the zero cross point becomes a value smaller than 3.54. This is because the widening of the brightness distribution on the back surface of the optical sheet is reduced with the higher directivity of the light from the light emission unit and the zero cross point gets closer to the position facing the light emission center of the light emission unit. In addition, in a case in which the directivity of the light from the light emission unit is low (for example, the light emission intensity complies with $\cos \frac{1}{3}\theta$, i.e., the light emission intensity distribution is expressed by a curve 192 in FIG. 10B), the Rd at the position facing the zero cross point becomes a value larger than 3.54. The above directivity may be controlled with the use of a lens or a reflection plate that changes the directivity and the diffusion of the light.

Accordingly, if the light source substrate has the plurality of light emission units with different light emission directivity, the positional relationship between the position of each of the light emission units and the position on the back surface of the optical sheet at which the absolute value of the change amount of the brightness with the deflection of the optical sheet is a predetermined value or less is different for each of the light emission units. For example, if the light source substrate has the light emission units with different lens shapes, the above positional relationship is different for each of the light emission units. In addition, the above positional relationship is different between the light emission units near the side wall of the backlight apparatus and the light emission units distant from the side wall of the backlight apparatus. Therefore, it is preferable that the distance between each of the light emission units 111 and the position (estimated position) at which the estimated detection value used to adjust the light emission brightness of the light emission units 111 is estimated be made different for each of the light emission units. For example, it is preferable that the distance between the light emission center of each of the light emission units and the estimated position be smaller with the higher directivity of the light from each of the light emission units. The Rd value at the estimated position may be made different for each of the light emission units. The estimated position and the Rd value at the estimated position may be determined (calculated) inside the backlight apparatus or may be prepared in advance. For example, the Rd value at the estimated position may be calculated from information expressing the directivity of the light from each of the light emission units and information expressing the graph in FIG. 10A. In addition, the estimated position (specifically, the distance between each of the light emission units and the estimated position) may be calculated from the determined Rd value and the diffusion distance. Note that although simulation values may be used as the position at which the estimated detection value is estimated and the Rd value at the position, these values are preferably determined based on the measurement results of the zero cross point.

As described above, according to the embodiment, the detection value of the detection unit assumed to be arranged so as to face the position on the back surface of the optical sheet at which the absolute value of the change amount of the brightness with the deflection of the optical sheet is a predetermined value or less is estimated as the estimated detection value. In other words, the detection value of the detection unit assumed to be arranged at the position at which the absolute value of the amount change of the detection value due to the deflection of the optical sheet is a predetermined value or less is estimated as the estimated detection value. Thus, as the detection value of the reflected light from the optical sheet, it is possible to obtain the estimated detection value that is less changed with the deflection of the optical sheet. According to the embodiment, the light emission brightness of each of the light emission units is adjusted based on such an estimated detection value. Thus, it is possible to adjust the light emission brightness of each of the light emission units with high accuracy.

Note that the embodiment describes the example of the case in which the light source substrate has the plurality of light emission units, it may have one light emission unit. In this case, it may also be possible to estimate, as the estimated detection value, the detection value of the detection unit at the position facing the position on the back surface of the optical sheet at which the absolute value of the change amount of the brightness with the deflection of the optical sheet is a predetermined value or less.

Note that the embodiment describes the example of the case in which the detection surface of each of the light sensors 113 is directed to the side of the optical sheet 106 (in the direction of the optical sheet among the directions perpendicular to the light source substrate), it may be directed in other directions. The detection surface of each of the light sensors 113 may be obliquely directed with respect to the direction perpendicular to the light source substrate so long as it is directed to the zero cross point (the position at which the change in the brightness with the deflection is a predetermined value or less) on the optical sheet.

Note that although only one of the light emission units is turned on to detect the light (specifically, the reflected light) from the light emission unit in the embodiment, some of the light emission units less susceptible to the light from the light emission unit may be turned on.

Note that the embodiment describes the example of the case in which two or more of the light sensors associated with one of the light emission units include the two light sensors laid across the position facing the position on the back surface of the optical sheet at which the absolute value of the change amount of the brightness with the deflection of the optical sheet is a predetermined value or less. Specifically, the embodiment describes the example of the case in which the estimated detection value is estimated based on interpolation using the two light sensors laid across the position facing the position on the back surface of the optical sheet at which the absolute value of the change amount of the brightness with the deflection of the optical sheet is a predetermined value or less as the adjustment light sensors. However, the positions of the adjustment sensors are not particularly limited so long as the estimated detection value is capable of being estimated. For example, the two or more adjustment light sensors may not be arranged so as to be laid across the position facing the position on the back surface of the optical sheet at which the absolute value of the change amount of the brightness with the deflection of the optical sheet is a predetermined value or less. Further, the estimated detection value may be estimated based on extrapolation.

Figure 11:
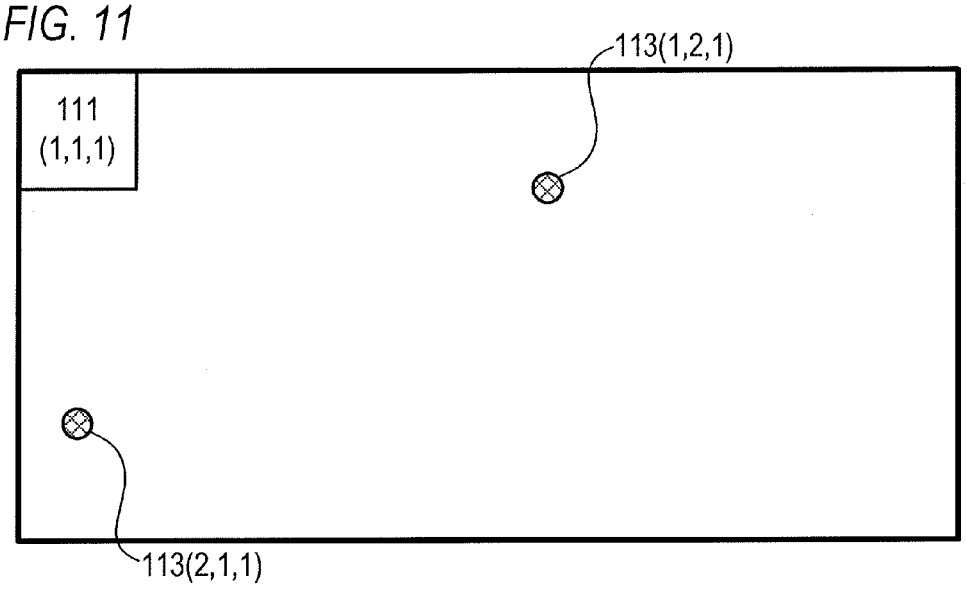
FIG. 11 is a view showing another example of the positional relationship between the light emission unit and the adjustment light sensors according to the embodiment.

Note that although the estimated detection value is estimated using the two or more light sensors 113 arranged side by side in one direction in the embodiment, the light sensors may be arranged in other ways. For example, as shown in FIG. 11, it is possible to estimate the estimated detection value using the two or more light sensors 113(2,1,1) and 113(1,2,1) arranged in different directions and with different distances from the light emission unit.

Note that the embodiment describes the example of the case in which each of the light emission units has one light emission point, the number of the light emission points is not limited to one. For example, each of the light emission units may have a plurality of light emission points. In this case, it is possible to use a value based on a state in which all the light emission points of one light emission unit are turned on as the position (Rd value) at which the estimated detection value is estimated.

Note that although the embodiment describes the example of the case in which a change in the directivity (the directivity of the light from each of the light emission units) due to a temperature change and degradation in the light emission units does not occur, the embodiment is not limited thereto. For example, it is possible to control total lighting time and ambient temperature for each of the light emission pars (for each of the LEDs), and change the position (Rd value) at which the estimated detection value is estimated based on the total lighting time and the ambient temperature for each of the light emission units. Specifically, using information (a table or a function) expressing the correspondence relationship between the total lighting time and the ambient temperature and the directivity, it is possible to determine the position at which the estimated detection value is estimated based on current total lighting time and ambient temperature. It may also be possible to consider only a change in the directivity due to the total lighting time (degradation in the light emission units) or consider only a change in the directivity due to a change in the temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-096365, filed on May 1, 2013, which is hereby incorporated by reference herein in its entirety.

What is claimed is:

1. A light source apparatus, comprising:

a light source substrate having a light emission unit;

an optical sheet arranged at a position facing the light emission unit;

a plurality of detection units configured to detect light from the light emission unit; and an adjustment unit configured to select two or more of the detection units from the plurality of detection units and adjust light emission brightness of the light emission unit on the basis of detection values of the selected two or more of detection units, wherein the two or more detection units include a first detection unit arranged at a position at which a change in the detection value due to a deflection of the optical sheet is positive when the light emission unit emits the light and a second detection unit arranged at a position at which the change in the detection value due to the deflection of the optical sheet is negative when the light emission unit emits the light.

2. The light source apparatus according to claim 1, wherein the adjustment unit estimates an estimated detection value, which is a detection value in a case where a detection unit is arranged at a position at which an amount of change of a detection value due to the deflection of the optical sheet is a predetermined value or less in use of the detection values of the two or more detection units, and adjusts the light emission brightness of the light emission unit on the basis of the estimated detection value.

3. The light source apparatus according to claim 2, wherein the adjustment unit estimates the estimated detection value by weighting and adding the detection values of the two or more detection units with weights according to distances between the light emission unit and the detection units.

4. The light source apparatus according to claim 2, wherein the predetermined value is 3%.

5. The light source apparatus according to claim 1, wherein the first detection unit and the second detection unit are two detection units laid across a position facing a position on a surface of the optical sheet at which an amount of change of brightness on the surface of the optical sheet due to the deflection of the optical sheet is zero.

6. The light source apparatus according to claim 1, wherein the light source substrate has a plurality of light emission units, each of the light emission units is associated with two or more of the detection units, and the adjustment unit adjusts the light emission brightness of the light emission unit by using the two or more detection units associated with the light emission unit.

7. The light source apparatus according to claim 6, wherein a positional relationship between a position of the light emission unit and a position on a surface of the optical sheet at which an amount of change of brightness on the surface of the optical sheet due to the deflection of the optical sheet is zero is different for each of the light emission units.

8. The light source apparatus according to claim 7, wherein each of the plurality of light emission units has different light emission directivity.

9. The light source apparatus according to claim 6, wherein the two or more detection units associated with the light emission unit do not include the detection unit closest to the light emission unit.

10. The light source apparatus according to claim 1, wherein the adjustment unit adjusts the light emission brightness of the light emission unit on the basis of the detection value of the first detection unit and the detection value of the second detection unit.

11. A light source apparatus, comprising:

a light source substrate having a light emission unit;

an optical sheet arranged at a position facing the light emission unit;

a plurality of detection units configured to detect light from the light emission unit; and an adjustment unit configured to select two or more of the detection units from the plurality of detection units and adjust light emission brightness of the light emission unit on the basis of detection values of the selected two or more of detection units, wherein the two or more detection units include the two detection units laid across a position facing a position on a surface of the optical sheet at which an amount of change of brightness on the surface of the optical sheet with a deflection of the optical sheet is a predetermined value or less when the light emission unit emits the light.

12. A light source apparatus, comprising:

a light source substrate having a light emission unit;

an optical sheet arranged at a position facing the light emission unit;

a plurality of detection units configured to detect light from the light emission unit; and an adjustment unit configured to select two or more of the detection units from the plurality of detection units and adjust light emission brightness of the light emission unit on the basis of detection values of the selected two or more of detection units, wherein the two or more detection units not include the detection unit closest to the light emission unit.

13. A method for controlling a light source apparatus including a light source substrate having a light emission unit, an optical sheet arranged at a position facing the light emission unit, and a plurality of detection units configured to detect light from the light emission unit, the method comprising:

acquiring detection values of the detection units;

selecting two or more of the detection units from the plurality of detection units; and adjusting light emission brightness of the light emission unit on the basis of the detection values of the selected two or more of the detection units, wherein the two or more detection units include a first detection unit arranged at a position at which a change in the detection value due to a deflection of the optical sheet is positive when the light emission unit emits the light and a second detection unit arranged at a position at which the change in the detection value due to the deflection of the optical sheet is negative when the light emission unit emits the light.

14. A method for controlling a light source apparatus including a light source substrate having a light emission unit, an optical sheet arranged at a position facing the light emission unit, and a plurality of detection units configured to detect light from the light emission unit, the method comprising:

acquiring detection values of the detection units;

selecting two or more of the detection units from the plurality of detection units; and adjusting light emission brightness of the light emission unit on the basis of the detection values of the selected two or more of detection units, wherein the two or more detection units include the two detection units laid across a position facing a position on a surface of the optical sheet at which an amount of change of brightness on the surface of the optical sheet due to a deflection of the optical sheet is a predetermined value or less when the light emission unit emits the light.

15. A method for controlling a light source apparatus including a light source substrate having a light emission unit, an optical sheet arranged at a position facing the light emission unit, and a plurality of detection units configured to detect light from the light emission unit, the method comprising:

acquiring detection values of the detection units;

selecting two or more of the detection units from the plurality of detection units; and adjusting light emission brightness of the light emission unit on the basis of the detection values of the selected two or more of detection units, wherein the two or more detection units do not include the detection unit closest to the light emission unit.

* * * * *